US005311714A

United States Patent [19]

Passeno

[11] Patent Number: 5,311,714

[45] Date of Patent: May 17, 1994

[54] BRICK PANEL APPARATUS

[75] Inventor: James K. Passeno, Fairbury, Nebr.

[73] Assignee: National Brick Panel Systems, Inc., Fairbury, Nebr.

[21] Appl. No.: 20,312

[22] Filed: Feb. 19, 1993

Related U.S. Application Data

[62] Division of Ser. No. 680,058, Apr. 3, 1991, Pat. No. 5,228,937.

[51] Int. Cl.[5] ..... E04F 13/08

[52] U.S. Cl. ..... 52/314; 52/387; 52/389; 52/391

[58] Field of Search ..... 52/385-387, 52/314, 309.12, 389-391, 384

[56] References Cited

U.S. PATENT DOCUMENTS

| | | | |
|---|---|---|---|
| 520,137 | 5/1894 | Deslauriers . | |
| 874,909 | 12/1907 | Fischer . | |
| 1,555,414 | 9/1925 | Hale . | |
| 2,003,996 | 6/1935 | Finzer . | |
| 2,054,511 | 9/1936 | Hornick | 52/385 X |
| 2,101,612 | 12/1937 | Duffy . | |
| 2,132,547 | 10/1938 | Sohn . | |
| 2,200,649 | 5/1940 | Wardle . | |
| 2,213,355 | 9/1940 | Woodworth . | |
| 2,300,258 | 10/1942 | Kublanow . | |
| 2,317,428 | 4/1943 | Anderson . | |
| 2,791,117 | 5/1957 | Bailey . | |
| 2,919,572 | 1/1960 | Salzi . | |
| 2,924,963 | 2/1960 | Taylor . | |
| 2,938,376 | 5/1960 | Workman . | |
| 3,331,180 | 7/1967 | Vissing . | |
| 3,387,422 | 6/1968 | Wanzer . | |
| 3,434,257 | 3/1969 | Sakuma . | |
| 3,520,095 | 7/1970 | Jonason . | |
| 3,533,206 | 10/1970 | Passeno . | |
| 3,908,326 | 9/1975 | Francis . | |
| 4,011,702 | 3/1977 | Matyas | 52/387 |
| 4,238,915 | 12/1980 | Yoshida . | |
| 4,244,155 | 1/1981 | Swiger . | |
| 4,407,104 | 10/1983 | Francis | 52/314 X |
| 4,407,107 | 10/1983 | Smith . | |
| 4,641,473 | 2/1987 | Trezza . | |
| 4,662,140 | 5/1987 | Porter . | |
| 4,736,552 | 4/1988 | Ward . | |
| 4,773,201 | 9/1988 | Trezza . | |
| 4,809,470 | 3/1989 | Bauer . | |
| 4,856,245 | 8/1989 | Osawa . | |
| 4,856,246 | 8/1989 | Shimasaki | 52/387 X |
| 4,916,875 | 4/1990 | Kashiwagi | 52/384 X |
| 4,920,716 | 5/1990 | Coffey | 52/387 X |
| 4,956,949 | 9/1990 | Francis . | |

OTHER PUBLICATIONS 12 pages —US Brick Systems.
8 pages—US Brick Systems.
1 sheet—entitled Brick Panel System—Typical Frame Wall Assembly (Masonry Wall Similar).
4 pages—R-Brick Panel System—Panelized Thin Brick Exterior Insulating Finish System.
6 pages—American Brick Panel Systems Inc.

*Primary Examiner*—Carl D. Friedman
*Assistant Examiner*—Robert J. Canfield
*Attorney, Agent, or Firm*—Henderson & Sturm

[57] ABSTRACT

A brick panel construction apparatus including a stiff backing member such as a polystyrene insulated board is laminated to a water impermeable sheet which is primarily planar in shape. A plurality of integrally formed projections are disposed in a plurality of horizontal rows on the impermeable sheet whereby these projections and the sheet constitute a one-piece structure. A plurality of spaced apart thin bricks are adhesively attached to the sheet and the bricks are disposed between the rows of projections. Grout is then applied to the spaces between the bricks and covers the rest of the sheet, including the projections. Brackets are utilized to attach the thin sheet and backing member to a vertical sub-straight and these brackets have a planar portion for allowing the fastener to pass through it, through the thin sheet and through the backing member to a vertical structural member. These brackets also have a top portion which supports the bottom of any brick it is under and also provides a mortar lock for ensuring that the mortar does not separate from the thin sheet.

29 Claims, 2 Drawing Sheets

BRICK PANEL APPARATUS

This application is a divisional of U.S. Ser. No. 07/630,058 filed Apr. 3, 1991, now U.S. Pat. No. 5,228,937.

TECHNICAL FIELD

The present invention relates generally to a brick panel structure and a method of making it and more particularly to such a construction which utilizes thin bricks so that the ultimate finished product looks like a conventional brick surface while at the same time the costs of manufacture are reduced dramatically.

BACKGROUND ART

Bricks constructed of a kiln baked clay or the like have been used for centuries as a building material. It is well known that bricks are typically used by placing mortar, such as a concrete mixture, between bricks and then simply laying one layer of bricks on top of another with this mortar disposed therebetween. Buildings constructed using this method have long been admired for their beauty, durability, and maintenance free attributes.

A major disadvantage of conventional brick construction is that it is expensive, labor intensive, and normally should must be done by people skilled in the brick laying art.

Because it is desirable to achieve the "look" of brick while at the same time trying to decrease the costs of construction, a thin brick has been utilized to form brick panels for the purpose of reducing the costs, reducing the time involved and reducing the amount of skill required to produce a brick construction.

For example, U.S. Pat. No. 4,809,470 to Bauer et al discloses the use of a thin plastic sheet bonded to an insulating panel and having continuous brick engaging ribs disposed horizontally thereon so that thin bricks can be adhesively affixed to the thin plastic sheet and held in place until mortar is applied between adjacent bricks and over the plastic ribs and plastic sheet to present a surface which looks from the outside to be just like a brick wall constructed by a skilled brick layer.

One of the problems associated with the thin brick system of the aforementioned prior art is that these continuous horizontal ribs do not permit water to drain therefrom as readily as is desirable. Once the foam backing and thin plastic sheet with the ribs thereon are attached to a sub-straight or vertical structural member, the exterior surface must be completely dry before the thin bricks are adhesively bonded thereto. If it rains before the bricks are attached, the water cannot readily drain off of these horizontal members and any water left on the ribs or thin plastic surface will diminish the structural integrity of the panel when the bricks are adhesively bonded thereto.

Furthermore, if the panel ever develops cracks in the brick or mortar or a combination thereof during its life while attached to the exterior of a building, moisture can obviously enter these cracks. Since cracks are always a possibility, especially since most construction is designed to last for decades, freezing and thawing of moisture in such cracks can cause the panel to deteriorate. Accordingly, it is important that if cracks develop, that the moisture which will inevitably enter these cracks will have a place to easily drain away so that freezing and thawing will be minimized. When continuous horizontal ribs are used to form such a thin brick panel as in the aforementioned prior art, these horizontal continuous ribs will prevent or seriously detract from the moisture draining process in a panel.

Consequently, there is a need for an improved thin brick panel structure and a method of forming such a structure that will maximize the drainage of water prior to adhesively attaching the bricks thereto and throughout the life of the brick panel if cracks should ever form or moisture should ever find its way through the bricks or mortar.

Another problem associated with the thin brick panels of the prior art is the problem of making sure that the mortar is properly locked to the thin plastic panel so that it will not, at some time in the future, simply separate and fall out, thereby presenting an unsightly appearance and destroying the moisture barrier that the mortar achieves.

Accordingly, there is a need for a better way to lock the mortar to the thin plastic sheet of a thin brick panel.

DISCLOSURE OF THE INVENTION

The present invention relates generally to a brick panel construction apparatus including a stiff backing member such as a polystyrene insulated board, a water impermeable sheet which is primarily planar in shape with one side of the sheet being laminated to one side of the backing member. A plurality of integrally formed projections are disposed in a plurality of horizontal rows on the impermeable sheet whereby these projections and the sheet constitute a one-piece structure. A plurality of spaced apart thin bricks are adhesively attached to the sheet and the bricks are disposed between the rows of projections. Grout is then applied to the spaces between the bricks and covers the rest of the sheet, including the projections. Brackets are utilized to attach the thin sheet and backing member to a vertical sub-straight and these brackets have a planar portion for allowing the fastener to pass through it and through the thin sheet and through the backing member to a vertical structural member. These brackets also have a top portion which supports the bottom of any brick it is under and also provides a mortar lock for ensuring that the mortar does not separate from the thin sheet.

An object of the present invention is to provide an improved brick panel structure.

A further object of the invention is to provide a brick panel construction which permits moisture to drain therefrom during the construction process.

A further object of the invention is to provide a way for moisture to drain off of the brick panel should a crack ever develop therein to thereby prevent further damage to the brick panel construction.

A still further object of the invention is to provide an improved thin brick panel method and apparatus which is economical, yet durable.

Other objects, advantages, and novel features of the present invention will become apparent from the following detailed description of the invention when considered in conjunction with the accompanying drawings.

BEST MODE FOR CARRYING OUT THE INVENTION

Figure 1:
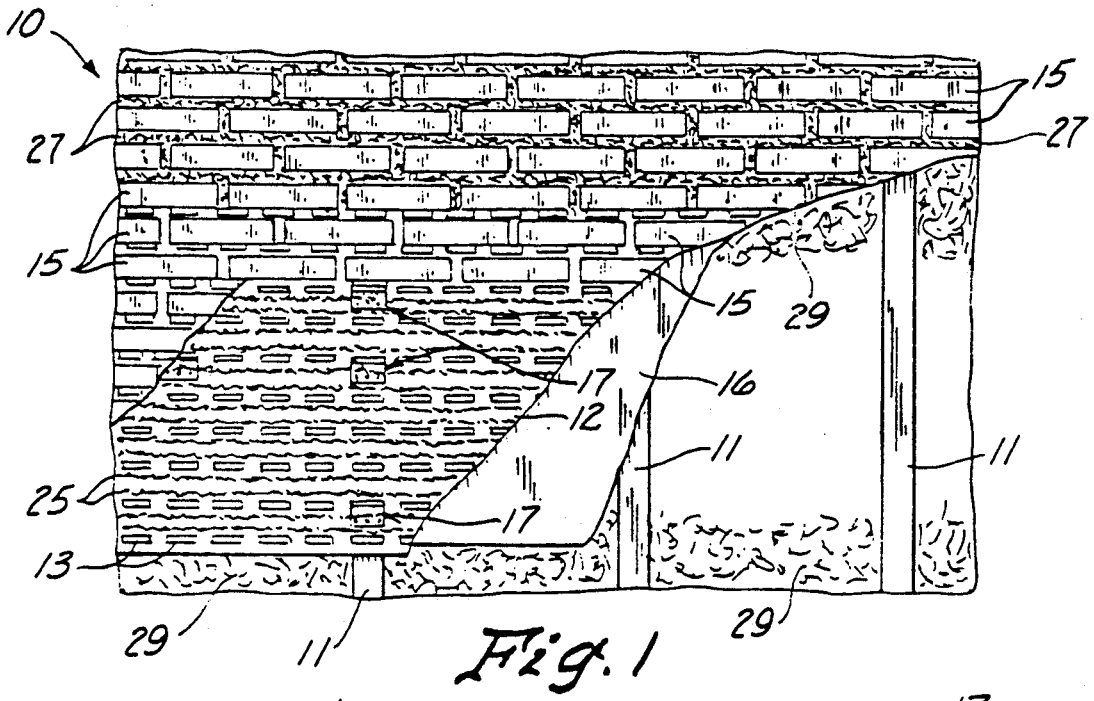
FIG. 1 is a side elevational view of the outside of a building which has a brick panel constructed in accordance with the present invention attached thereto and further having layers stripped off of the structure to show each layer.

Referring now to the drawings wherein like reference numerals designate identical or corresponding parts throughout the several views, FIG. 1 shows a brick panel (10) constructed in accordance with the present invention and shows it attached to upright, vertical, structural members (11), such as 2×6 inch studs in a building.

A vacuum formed high impact polystyrene sheet (12) is preferably constructed of a polystyrene having some colorant therein for the purpose of reflecting ultraviolet rays from the sun. This material can be a random gray material reground from other waste polystyrene materials. Alternatively, carbon can be added as an ultraviolet absorbent for reasons which will be discussed below.

Projections (13) in the sheet (12) are vacuum formed into the sheet (12) in parallel horizontal rows. These projections (13) have a top shelf (14) for permitting a brick (15) to rest thereon and a lower portion (13*a*) as can readily be seen in FIG. 6. The sheet (12) is laminated to an extruded foam polystyrene backing member (16) in the relationship shown in FIG. 2 such that the bottom portion of the sheet (12) extends downwardly to overlap the sheet (12) of the panel below it and extends to the left beyond the backing member (16) so that it will overlap the sheet (12) to its left. This overlapping relationship is provided for ensuring a good water tight seal to prevent moisture from entering the building to which it is attached.

Figure 3:
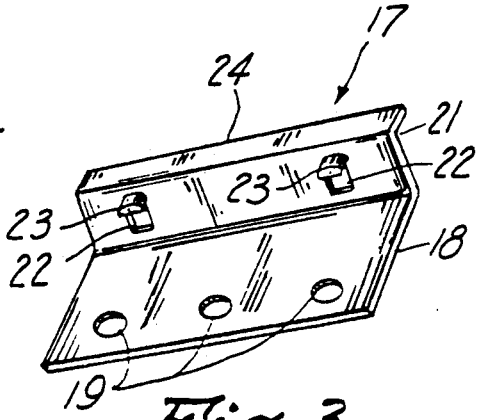
FIG. 3 is a perspective view of a bracket for attaching the panels to a vertical upright member and providing a mortar lock.
Figure 6:
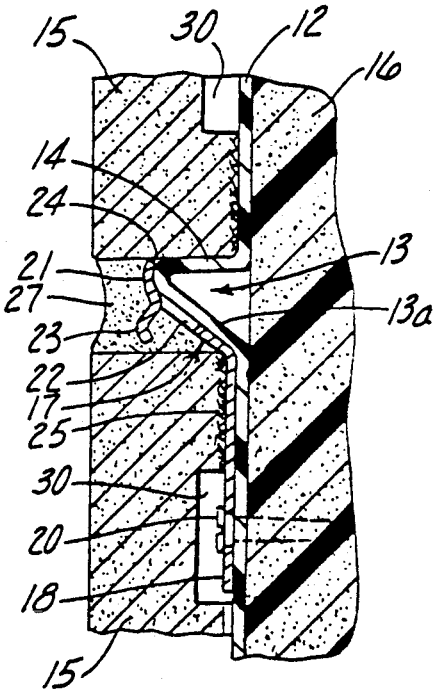
FIG. 6 is an enlarged partial cross sectional view taken along line 6—6 of FIG. 4 and showing the bracket which attaches the brick panel to a vertical upright member and shows how this bracket provides a mortar lock to ensure that the mortar and brick does not separate from the vacuum formed polystyrene sheet.

Brackets (17), preferably constructed of galvanized steel, are utilized to attach the brick panel (10) to upright structural members (11) in a manner which will be discussed below. These brackets (17) include a planar lower portion (18) having a plurality of openings (19) disposed therein for receiving fasteners such as screws (20) as shown in FIG. 6. A top portion (21) of the brackets (17) have openings (22) stamped therein and flanges (23) extending outwardly therefrom as can best be seen in FIGS. 3 and 6. The top portion (21) of the bracket (17) is preferably formed to conform to the shape of the lower portion (13*a*) of the projections (13) as shown in FIG. 6. The top edge (24) of the bracket (17) is adapted to be in abutment with the bottom of bricks (15), also as shown in FIG. 6.

Figure 2:
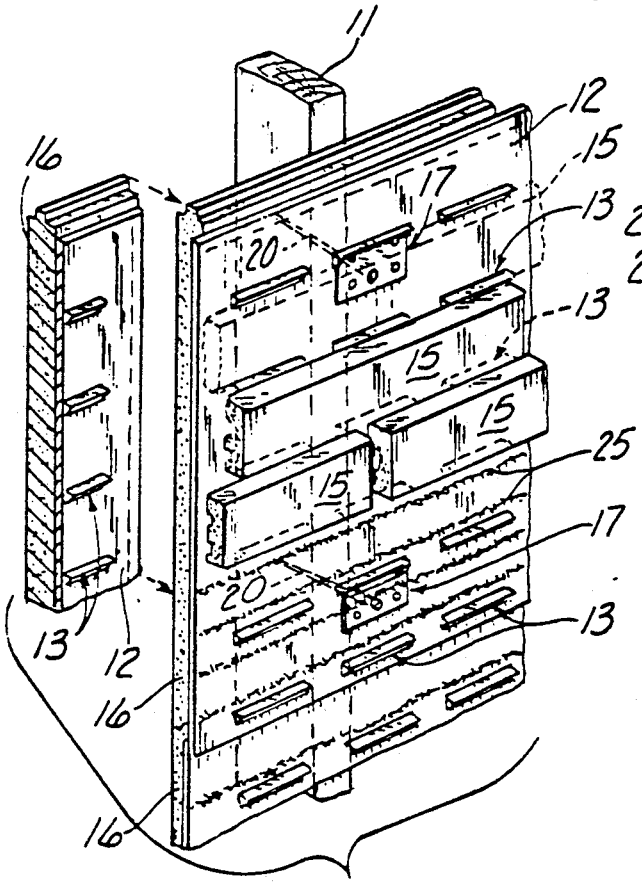
FIG. 2 is an enlarged perspective view of a portion of three different abutting panels to show how they fit together and also showing where the bricks are placed and how brackets are used to attach the panel to an upright structural member.

To construct and install the brick panel (10) shown in FIG. 1, a plurality of units of the extruded polystyrene backing members (16) are pre-laminated to the sheets (12) so that they can be attached to the upright structural members (11) in the overlapping relationship shown in FIG. 2 wherein someone installing this system would typically start at the lower left side of a wall and work upwardly and to the right, although it will be clear to those skilled in this art that the overlapping relationship could be on the right side of each panel rather than on the left side if desired.

As each of the units of composite sheet (12) and backing member (16) are attached to the upright members (11), it will be appreciated that the bracket (17) needs to be aligned with the upright structural members (11), for example as shown in FIG. 1, so that screws (20) can extend through openings (19) and the bracket (17), through the sheets (12) and backing members (16) to engage the studs (11) as shown in FIG. 2.

After the entire surface desired to have the brick panel disposed thereon is covered with the composite units of sheets (12) and backing members (16) and attached by brackets (17), high solid solvent based adhesives (25) are attached to the sheet members (12). This adhesive (25) is preferably of a low solvent type that burns into and fuses with the styrene sheeting (12) and also readily adheres to bricks (15).

Figure 4:
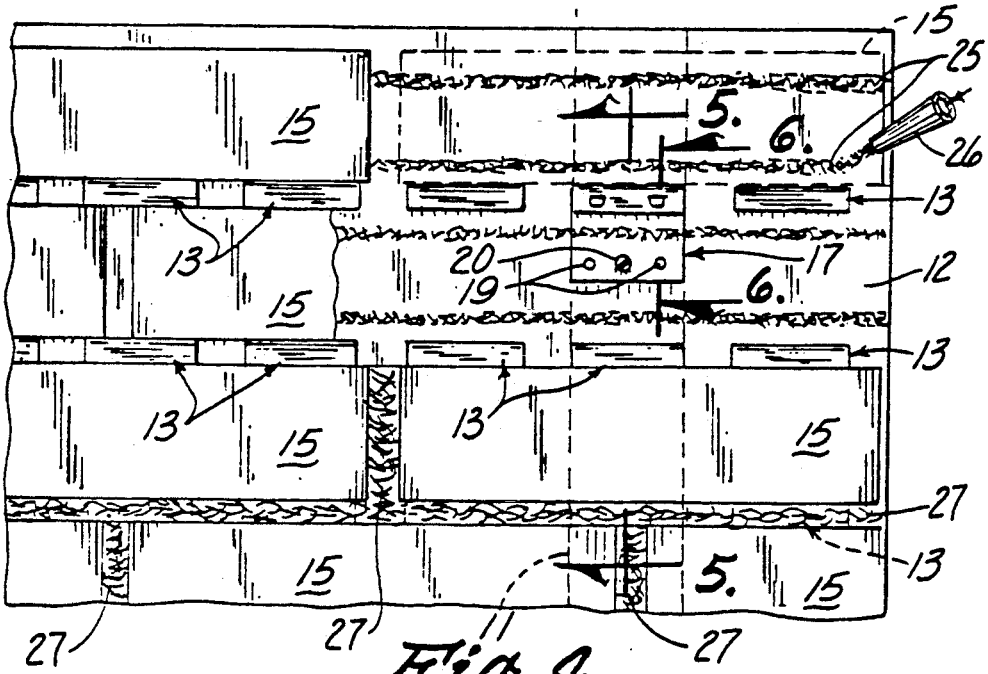
FIG. 4 is an enlarged side elevational view showing part of the process of construction of the brick panel of the present invention showing how the bricks are aligned and adhesively attached to the thin sheet of polystyrene material.
Figure 5:
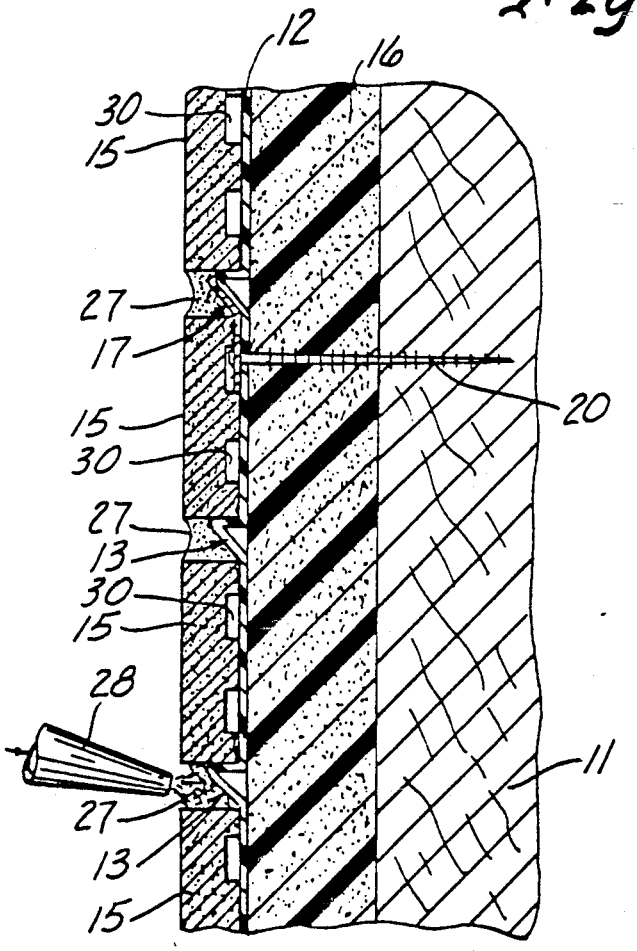
FIG. 5 is a cross sectional view taken along line 5—5 of FIG. 4 and showing the final grouting part of the process of installing the brick panels.

Once the adhesive (25) is attached, as shown by adhesive (25) from adhesive applicator (26) in FIG. 4, the bricks (15) are placed between rows of projections (13) and are placed on top of the shelf (14) of these projections (13) as shown in FIGS. 5 and 6 in a spaced apart normal relationship of bricks as shown in FIG. 4 to permit mortar to be later placed therearound. Referring to FIG. 6, it is noted that in those places where a bracket (17) is present, the top portion (24) thereof will contact the lower portion of the brick (15) just above it to support such brick (15). It is noted that the bricks (15) each have grooves (30) formed in the back thereof which may be formed during an extruding process which forms the bricks (15). The holes (19) in bracket (17) are spaced with respect to projections (13) such that the fastener (20) is positioned so that the head of the fastener (20) extends into the grooves (30) to prevent the head (20) from pushing the brick (25) away from the sheet (12) which would interfere with bonding the bricks (15) to the sheet (12).

If it should happen to rain or if for any other reason water gets onto the sheet (25), it will readily drain downwardly and between the spaces between the projections (13) so that the surface can immediately become dry. Furthermore, if it happens that the bricks (15) cannot be applied within a day or two, the ultraviolet light blocking properties of the sheet (12) will prevent deterioration of the polystyrene sheet (12). If the polystyrene sheet (12) does not have something to block these ultraviolet rays from the sun, this sheet (12) can quickly deteriorate, for example if it is merely a white sheet of polystyrene with no carbon added. The precise shelf angles of projections (13) support the bricks (15) until the adhesive is cured and they also assure straight, uniform mortar lines.

After the adhesive (25) has been given enough time to be cured, grouting mortar (27) is applied through an applicator (28) as is shown in FIG. 5. The applicator (28) can be a grout bag or an approved pump system. Once the mortar (27) has been applied in a plastic condition around all of the bricks (15), this mortar is allowed to cure.

It will be appreciated that this mortar also forms a moisture block which not only fills the space between the bricks, but also fills some of the space between the foam board (16). The mortar extends over, around and between adjacent projections (13) and the mortar will lock onto these projections (13) because of this arrangement. Furthermore, the mortar will extend around flanges (23) on brackets (17) and into openings (22). Since these brackets (17) are ultimately attached to the structural members (11), this mortar (27) is solidly looked thereto through this rigid attachment of fasteners (20), bracket (17) and flange (23).

Accordingly, it will be appreciated that the preferred embodiment shown herein does indeed accomplish the aforementioned objects. Obviously, many modifications and variations of the present invention are possible in light of the above teachings. For example, while the brick panel (10) is connected to the exterior of a building represented by structural members (11), it could also be attached to the inside of a building wall and in such a case, the extruded foam (16) may be replaced with drywall or gypsum board if no further insulating properties are desired. This may be especially true if the interior of the walls have insulation (29) therein as is shown in FIG. 1. It is therefore to be understood that, within the scope of the appended claims, the invention may be practiced otherwise than as specifically described.

I claim:

1. A brick panel construction apparatus comprising:
a stiff backing member;
a water impermeable sheet, which is primarily planer in shape, one side of said sheet being attached to one side of said backing member;
a plurality of integrally formed spaced apart projections disposed in a plurality of horizontal rows on said impermeable sheet whereby said projections and said sheet constitute a one piece structure, said projections extending to the other side of said sheet, at least some of the projections which are adjacent to each other in each of the horizontal rows being spaced from each other by portions of said primarily planer in shape water impermeable sheet;
a plurality of spaced apart bricks attached to said other side of said sheet, said bricks being disposed between said rows of projections; and
grout disposed between adjacent bricks and covering said sheet and said projections.

2. The apparatus of claim 1 wherein said sheet is constructed of vacuum formed polystyrene material.

3. The apparatus of claim 1 wherein said sheet and projections are comprised of one sheet of vacuum formed polystyrene material.

4. The apparatus of claim 1 wherein said stiff backing member is comprised of extruded polystyrene foam material.

5. The apparatus of claim 1 wherein an adhesive means is provided between each of the bricks and said sheet, thereby bonding the bricks to said sheet.

6. The apparatus of claim 1 including a vertical structural member and means for attaching said panel construction apparatus to said vertical structural member.

7. The apparatus of claim 6 wherein said attaching means comprises a bracket in abutment with said other side of said sheet and having a fastener means extending therethrough, said fastener means extending into said vertical structural member.

8. The apparatus of claim 1 wherein each of said projections includes a top shelf and a lower portion, the bottom of one of said bricks being disposed on said top shelf.

9. The apparatus of claim 8 including a bracket having a planar lower portion in abutment with said sheet and an upper portion disposed underneath and in contact with the lower portion of one of said projections.

10. The apparatus of claim 9 wherein said upper portion of said bracket includes at least one flange means for permitting grout to be disposed between said flange and one of said projections whereby said grout and bricks will be further secured from separation with said sheet.

11. The apparatus of claim 10 including means for attaching said panel construction apparatus to said vertical structural member and means for fastening said bracket and said sheet to said vertical structural member.

12. The apparatus of claim 11 wherein said fastening means extends through said bracket, through said sheet and into said vertical structural member.

13. The apparatus of claim 12 wherein the extreme upper portion of said bracket is in contact with the lower bottom of a brick disposed on said shelf for further supporting said brick.

14. The apparatus of claim 13 wherein said brick has at least one groove disposed on the back side thereof, and said fastener means extends at least partially into said groove whereby the brick can be in more complete abutment with said sheet to insure a strong attachment to said sheet.

15. The apparatus of claim 1 wherein said sheet is comprised of vacuum formed polystyrene material.

16. The apparatus of claim 15 wherein said polystyrene material includes means for blocking the ultraviolet rays of the sun to prevent damage to said polystyrene material during the construction process of said brick panel construction apparatus.

17. The apparatus of claim 1 wherein said stiff backing member is constructed of extruded polystyrene foam.

18. The apparatus of claim 1 wherein said stiff backing member is constructed of sheetrock or gypsum board.

19. A brick panel construction apparatus comprising:
a stiff backing member;
a water impermeable sheet, which is primarily planer in shape, one side of said sheet being attached to one side of said backing member;
a plurality of integrally formed spaced apart projections disposed in a plurality of horizontal rows on said impermeable sheet whereby said projections and said sheet constitute a one piece structure, said projections extending to the other side of said sheet;
a plurality of spaced apart bricks attached to said other side of said sheet, said bricks being disposed between said rows of projections;
wherein each of said projections includes a top shelf and a lower portion, the bottom of one of said bricks being disposed on said top shelf,
grout disposed between adjacent bricks and covering said sheet and said projections;
a vertical structure member;

means for attaching said panel construction apparatus to a vertical structural member; and wherein said attaching means comprises a bracket in abutment with said other side of said sheet and having a fastener means extending therethrough, said fastener means extending into said vertical structural member, said bracket having a planar lower portion in abutment with said sheet and an upper portion disposed underneath and in contact with the lower portion of one of said projections.

20. The apparatus of claim 19 wherein said upper portion of said bracket includes at least one flange means for permitting grout to be disposed between said flange and one of said projections whereby said grout and bricks will be further secured from separation with said sheet.

21. The apparatus of claim 10 including means for attaching said panel construction apparatus to said vertical structural member and means for fastening said bracket and said sheet to said vertical structural member.

22. The apparatus of claim 20 wherein said fastening means extends through said bracket, through said sheet and into said vertical structural member.

23. The apparatus of claim 21 wherein the extreme upper portion of said bracket is in contact with the lower bottom of a brick disposed on said shelf for further supporting said brick.

24. The apparatus of claim 22 wherein said brick has at least one groove disposed on the back side thereof, and said fastener means extends at least partially into said groove whereby the brick can be in more complete abutment with said sheet to insure a strong attachment to said sheet.

25. The apparatus of claim 19 wherein said sheet is comprised of vacuum formed polystyrene material.

26. The apparatus of claim 24 wherein said polystyrene material includes means for blocking the ultraviolet rays of the sun to prevent damage to said polystyrene material during the construction process of said brick panel construction apparatus.

27. The apparatus of claim 19 wherein said stiff backing member is constructed of extruded polystyrene foam.

28. The apparatus of claim 19 wherein said stiff backing member is constructed of sheetrock or gypsum board.

29. A brick panel construction apparatus comprising:

a water impermeable sheet, which is primarily planer in shape, one side of said sheet being adapted to be attached to a stiff backing member;

a plurality of projections disposed in said sheet on the other side of said sheet;

a drainage structure disposed between adjacent projections for allowing water to drain down past said adjacent projections on said other side of said sheet when said sheet is in a vertical orientation, a plurality of spaced apart bricks attached to said other side of said sheet, said bricks being disposed between said projections; and grout disposed between adjacent bricks and substantially covering said sheet and said projections.

* * * * *